US007690959B1

(12) United States Patent
Szilagyi et al.

(10) Patent No.: US 7,690,959 B1
(45) Date of Patent: Apr. 6, 2010

(54) MOUNTING ARRANGEMENT FOR A DRIVE UNIT OF A BOAT, AND BOAT WITH MOUNTING ARRANGEMENT FOR A DRIVE UNIT

(75) Inventors: Edmund Alexander Szilagyi, Virginia Beach, VA (US); David John Anspach, Chesapeake, VA (US); Andrew Ross Pelton, Virginia Beach, VA (US)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 12/350,521

(22) Filed: Jan. 8, 2009

(51) Int. Cl.
*B63H 1/15* (2006.01)

(52) U.S. Cl. ..... 440/52; 440/112

(58) Field of Classification Search ..... 440/52, 440/75, 76, 112
See application file for complete search history.

(56) References Cited

U.S. PATENT DOCUMENTS 3,324,821 A 6/1967 Laughlin
3,982,496 A * 9/1976 Blanchard ..... 440/52
4,040,378 A * 8/1977 Blanchard ..... 440/52
4,273,545 A * 6/1981 Pehrsson ..... 440/75
4,907,994 A * 3/1990 Jones ..... 440/75
6,315,623 B1 11/2001 Hedlund
7,182,657 B2 2/2007 Mansson

* cited by examiner

*Primary Examiner*—Lars A Olson
(74) *Attorney, Agent, or Firm*—WRB-IP LLP

(57) ABSTRACT

A mounting arrangement is provided for mounting a boat drive to a boat hull and includes a mounting collar including a first plate having a first opening therein and a first wall extending from a top surface of the first plate around the first opening and defining a first cylinder. The mounting arrangement also includes a clamping collar including a second plate having a second opening therein and a second wall extending from a top surface of the second plate around the second opening and defining a second cylinder, an external shape of at least a top end of the first cylinder substantially matching an internal shape of at least a bottom end of the second cylinder. The first wall of the mounting collar has a first alignment member and the second wall of the clamping collar has a second alignment member, the first alignment member and the second alignment member being positioned so that, when the first plate is mounted against an exterior of the boat hull and the second plate is mounted against an interior of the boat hull with the first cylinder received in the second cylinder, the first alignment member and the second alignment member align when the boat hull is at least a predetermined thickness.

20 Claims, 5 Drawing Sheets

MOUNTING ARRANGEMENT FOR A DRIVE UNIT OF A BOAT, AND BOAT WITH MOUNTING ARRANGEMENT FOR A DRIVE UNIT

BACKGROUND AND SUMMARY

The present invention relates generally to outboard drive units and, more particularly, for mounting arrangements for outboard drive units.

Certain known outboard drive units have a leg or underwater body extending down from an underside of a hull bottom and have been mounted in different manners. In one case, the leg is rigidly joined to the engine and extends through an opening in the hull bottom, with a rubber bellows or the like forming a seal between the leg and the edge of the surrounding opening. The pushing forces of the propeller are taken up by the engine and the engine mounting. In the second case, the leg or the underwater housing is fixed to a plate which is screwed securely, or fixed in some other manner, to the bottom of the hull. In this case the entire propeller force can be taken up by the hull or a portion can be taken up by the hull and a portion by the drive unit mounted on the inside of the hull, i.e. the engine and transmission.

U.S. Pat. No. 7,182,657 discloses a third mounting arrangement wherein the boat hull is formed with a vertical well having an internal flange. The boat hull is used with a drive unit having a vertical drive shaft with an underwater housing connected to an upper gear housing, the upper gear housing having a horizontal shaft for connection to an engine. A mounting plate of a drive unit and a screw-down plate are fastened to opposite sides of the flange, with compressible rings between surfaces of the mounting plate and the flange and between surfaces of the screw-down plate and the flange. The rings damp vibrations from the drive to the hull. The propeller forces are transmitted via the mounting plate and the screw-down plate to the flange and the well and, thus, to the boat hull. This permits mounting of the engine inside the hull on relatively soft, vibration-damping pads. A problem with this mounting arrangement is that it does not prevent the drive unit from being mounted to a hull that is of insufficient thickness to support the drive unit. In addition, formation of the well adds to the difficulty of forming the hull.

It is desirable to provide a mounting arrangement for mounting a boat drive to a boat hull that is simple to manufacture. It is also desirable to prevent mounting of boat drives to boat hulls of insufficient thickness.

In accordance with an aspect of the present invention, a mounting arrangement for mounting a boat drive to a boat hull is provided and comprises a mounting collar comprising a first plate having a first opening therein and a first wall extending from a top surface of the first plate around the first opening and defining a first cylinder. The mounting arrangement also comprises a clamping collar comprising a second plate having a second opening therein and a second wall extending from a top surface of the second plate around the second opening and defining a second cylinder, an external shape of at least a top end of the first cylinder substantially matching an internal shape of at least a bottom end of the second cylinder. The first wall of the mounting collar has a first alignment member and the second wall of the clamping collar has a second alignment member, the first alignment member and the second alignment member being positioned so that, when the first plate is mounted against an exterior of the boat hull and the second plate is mounted against an interior of the boat hull with the first cylinder received in the second cylinder, the first alignment member and the second alignment member align when the boat hull is at least a first predetermined thickness.

In accordance with another aspect of the present invention, a boat comprises a hull, the hull having a wall and an opening extending through the wall, a drive unit comprising a mounting plate having an upwardly facing, substantially frustoconical mounting surface, a hold down plate having a downwardly facing, substantially frustoconical mounting surface, and a mounting arrangement for mounting the boat drive to the boat hull. The mounting arrangement comprises a mounting collar comprising a first plate having a first opening therein and a first wall extending from a top surface of the first plate around the first opening and defining a first cylinder, the first wall comprises a peripheral flange extending around an inside of the wall, a clamping collar comprising a second plate having a second opening therein and a second wall extending from a top surface of the second plate around the second opening and defining a second cylinder, an external shape of at least a top end of the first cylinder substantially matching an internal shape of at least a bottom end of the second cylinder. The peripheral flange comprises a downwardly facing, substantially frustoconical mounting surface arranged to face the upwardly facing, substantially frustoconical mounting surface of the mounting plate of the drive unit, and an upwardly facing, substantially frustoconical mounting surface arranged to face the downwardly facing, substantially frustoconical mounting surface of the hold down plate.

In accordance with yet another aspect of the present invention, a method of mounting a drive unit to a hull of a boat is provided. According to the method, a mounting collar comprising a first plate having a first opening therein and a first wall extending from a top surface of the first plate around the first opening and defining a first cylinder, the first wall comprising a peripheral flange extending around an inside of the wall, is positioned so that the top of the first plate faces a bottom of the hull and so that the first wall extends upwardly through an opening in a wall of the hull. A clamping collar comprising a second plate having a second opening therein and a second wall extending from a top surface of the second plate around the second opening and defining a second cylinder, an external shape of at least a top end of the first cylinder substantially matching an internal shape of at least a bottom end of the second cylinder, is positioned so that a bottom of the second plate faces a top of the hull and the first cylinder is at least partially received in the second cylinder. A mounting plate of the drive unit is positioned so that an upwardly facing, substantially frustoconical mounting surface of the mounting plate faces a downwardly facing, substantially frustoconical mounting surface of the peripheral flange. A hold down plate is positioned so that a downwardly facing, substantially frustoconical mounting surface of the hold down plate faces the upwardly facing substantially frustoconical mounting surface of the peripheral flange. The hold down plate is fastened to the mounting plate via fasteners.

BRIEF DESCRIPTION OF THE DRAWINGS

The features and advantages of the present invention are well understood by reading the following detailed description in conjunction with the drawing in which like numerals indicate similar elements and in which.

DETAILED DESCRIPTION

Figure 1:
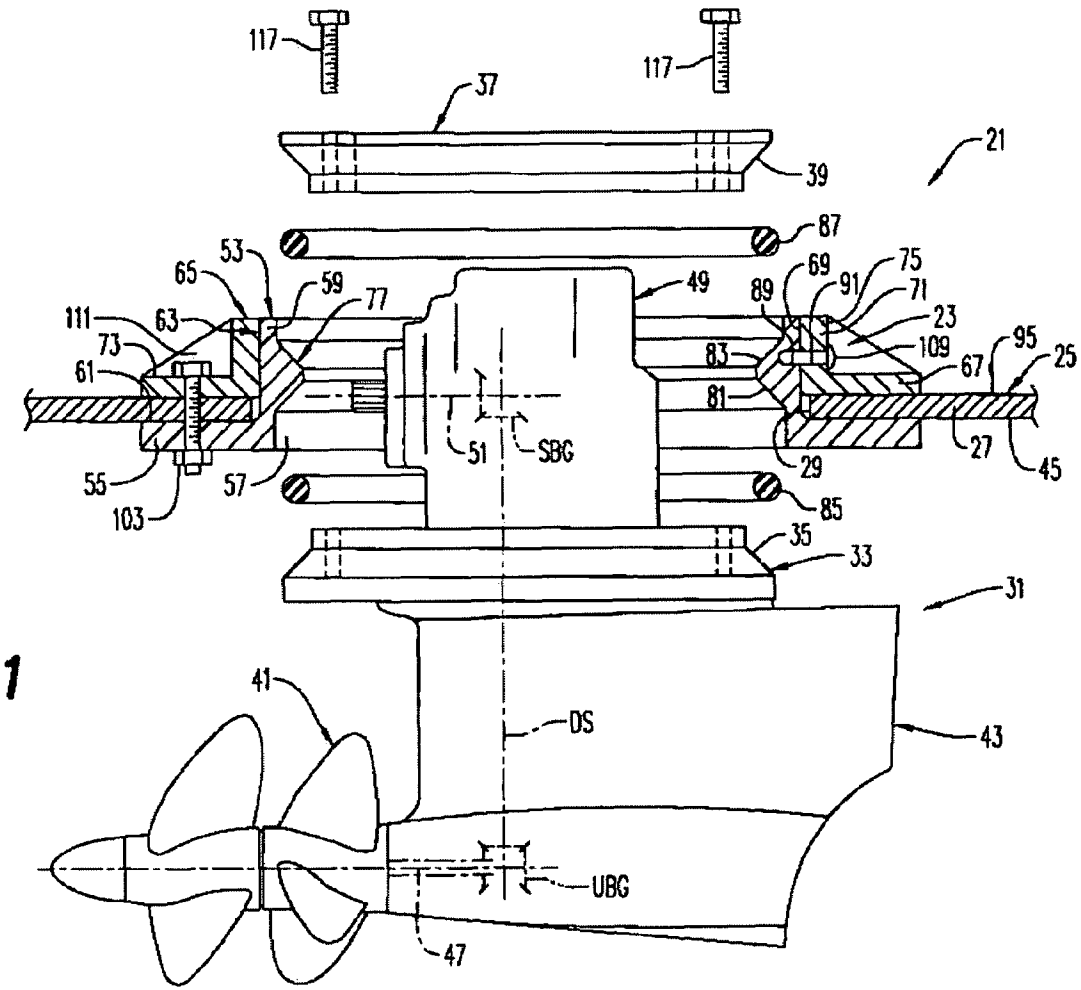
FIG. 1 shows, partially exploded and partially cross-sectional, a portion of a boat including a hull with a mounting arrangement according to an embodiment of the present invention.
Figure 2:
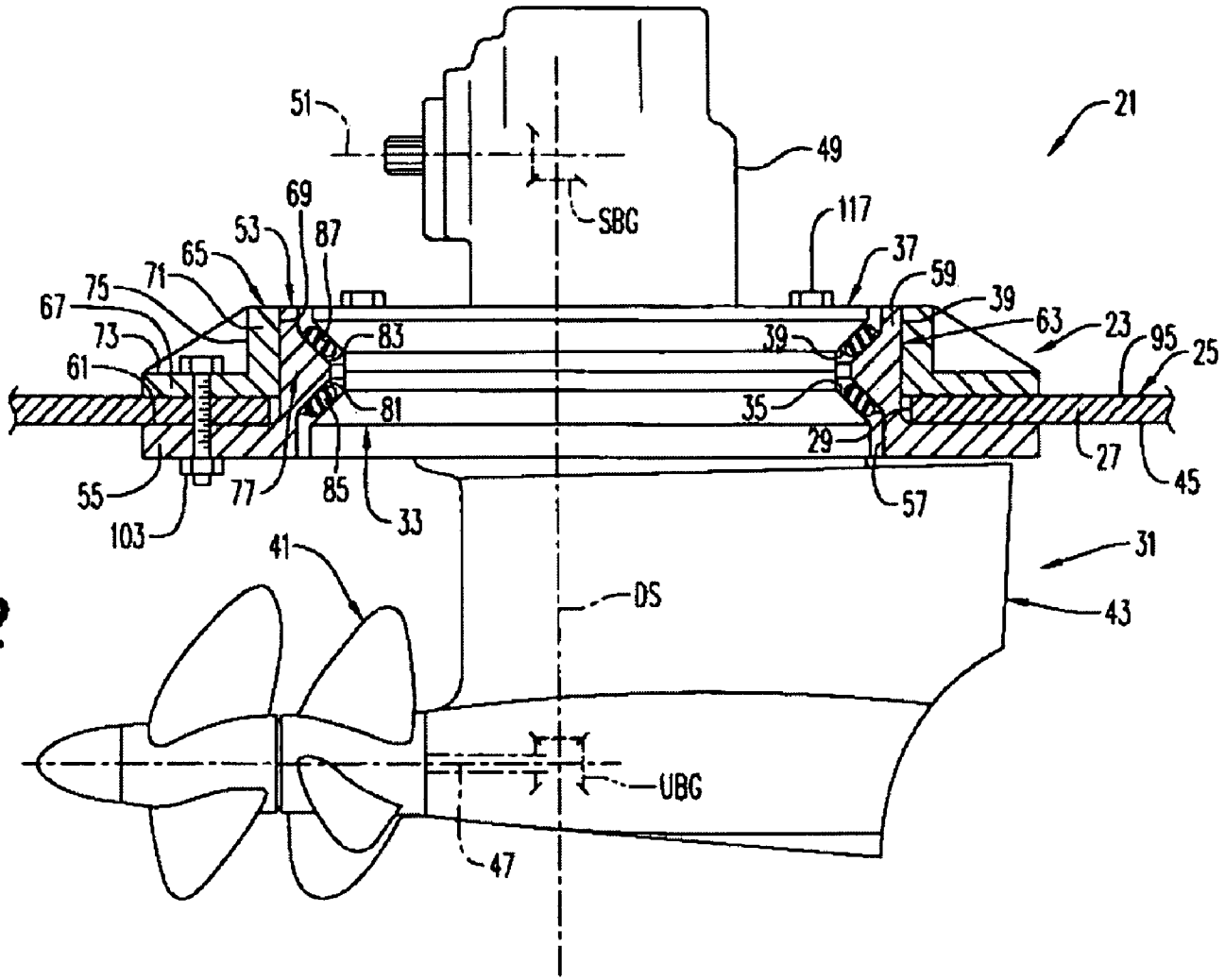
FIG. 2 shows, partially in cross-section, the portion of the boat shown in FIG. 1 in an assembled fashion.
Figure 5:
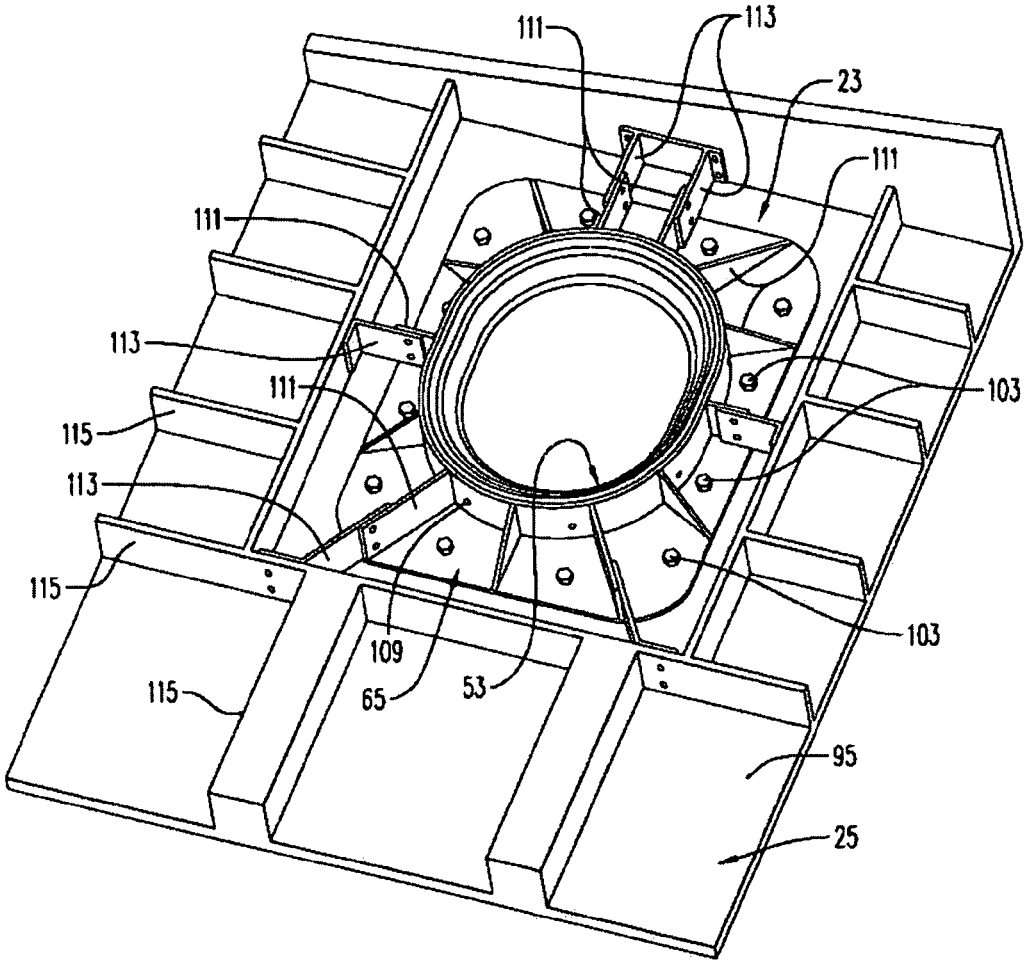
FIG. 5 is a perspective view of a clamping collar mounted inside the hull of a boat according to an aspect of the present invention.

A portion of a boat 21 having a mounting arrangement 23 for mounting a boat drive unit 31 to a boat hull 25 is shown in FIGS. 1, 2, and 5. As seen in FIGS. 1 and 2, the hull 25 has a wall 27 and an opening 29 extending through the wall. The drive unit 31 comprises a mounting plate 33 having an upwardly facing, substantially frustoconical mounting surface 35. A hold down plate 37 is provided and has a downwardly facing, substantially frustoconical mounting surface 39.

The drive unit 31 can comprise an outboard drive unit for at least one propeller 41, the drive unit comprising an underwater housing 43 extending down from the outside or bottom 45 of the hull, and an at least substantially vertical drive shaft DS (shown in phantom in FIGS. 1 and 2) being rotatably mounted in the underwater housing, extending through the opening 29 in the bottom of the hull and driving, via a bevel gearing UBG (shown in phantom in FIGS. 1 and 2) enclosed in the underwater housing, at least one at least substantially horizontal propeller shaft 47 (shown in phantom) mounted in the underwater housing. U.S. Pat. No. 7,182,657 is incorporated by reference at least for its disclosure of a drive unit suitable for use in connection with aspects of the present invention at Col. 2, line 40, to Col. 3, line 45. The drive unit 31 can also comprise a gearing housing 49 joined to the underwater housing 43 and comprising a second bevel gearing SBG (shown in phantom in FIGS. 1 and 2), via which the upper end of the essentially vertical drive shaft DS is drivably coupled to a substantially horizontal shaft 51.

The mounting arrangement 23 can include a mounting collar 53 (shown by itself in FIG. 3A) comprising a first plate 55 having a first opening 57 therein, and a first wall 59 extending from a top surface 61 of the first plate around the first opening and defining a first cylinder 63. The mounting arrangement 23 can also include a clamping collar 65 (shown by itself in FIG. 3B) comprising a second plate 67 having a second opening 69 therein and a second wall 71 extending from a top surface 73 of the second plate around the second opening and defining a second cylinder 75. An external shape of at least a top end of the first cylinder 63 substantially matches an internal shape of at least a bottom end of the second cylinder 75. When the mounting arrangement 23 is secured in place on the hull 25, structural adhesive (not shown) can be provided between the exterior of the first cylinder 63 and the interior of the second cylinder 75.

The first wall 59 can comprise a peripheral flange 77 extending around an inside of the wall. The peripheral flange 77 can comprise a downwardly facing, substantially frustoconical mounting surface 81 arranged to face the upwardly facing, substantially frustoconical mounting surface 35 of the mounting plate 33 of the drive unit 31. The peripheral flange 77 can also comprise an upwardly facing, substantially frustoconical mounting surface 83 arranged to face the downwardly facing, substantially frustoconical mounting surface 39 of the hold down plate 37. Compressible rings 85 and 87 can be positioned between surfaces 81 and 35 and between the surfaces 83 and 39 for sealing the first opening 57 when the mounting arrangement 23 is secured to the hull 25 of the boat 21. The compressible rings 85 and 87 can also help to absorb forces from the drive unit 31 to transmit them to the boat hull 25. Fasteners 117 such as bolts, screws, rivets, or the like can be provided to fasten the mounting plate 33 and the hold down plate 37 to each other with the peripheral flange 77 sandwiched between them.

Figure 4:
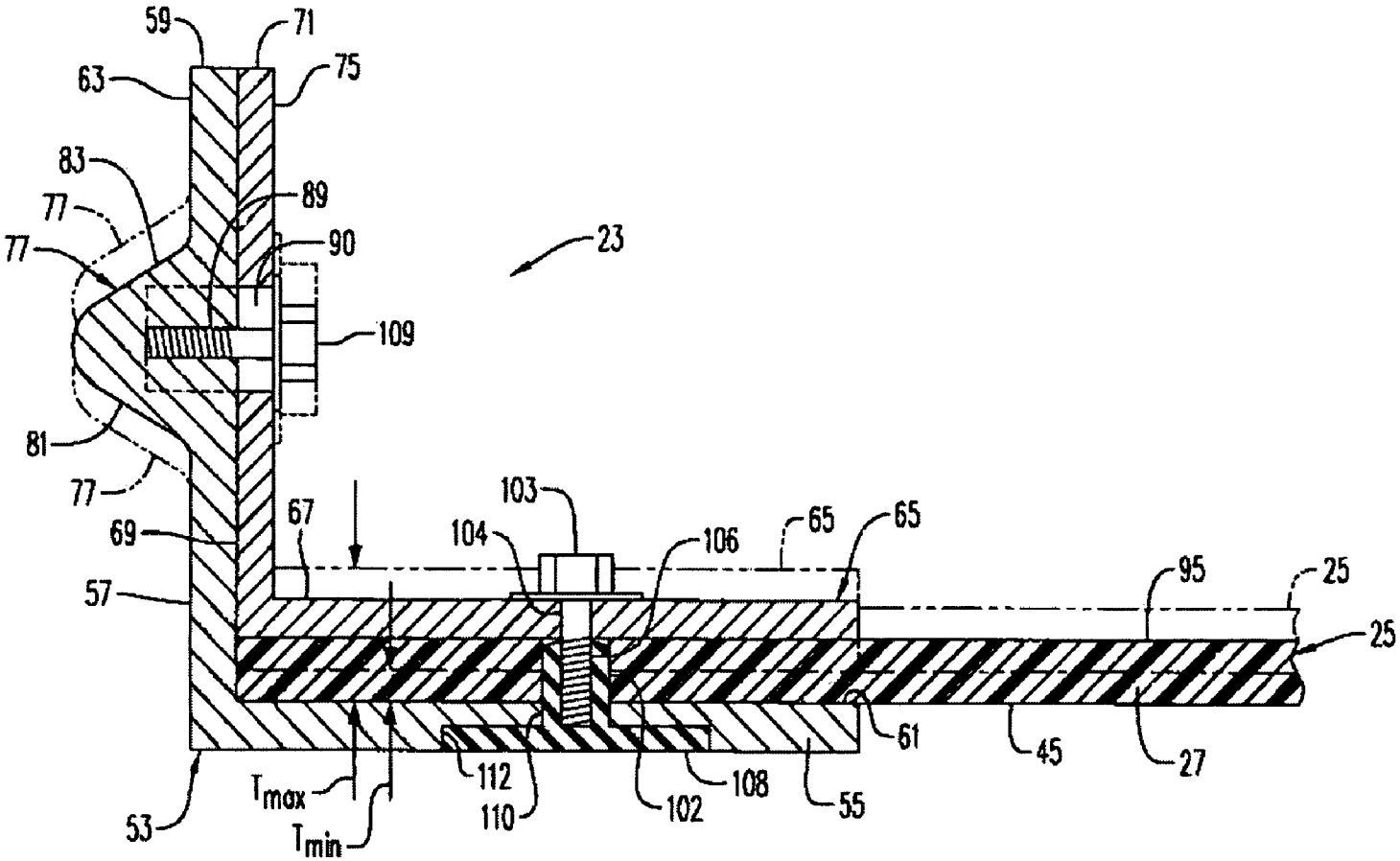
FIG. 4 is a schematic, partial, cross-sectional view of portions of a mounting collar and a clamping collar including alignment members for accommodating different hull wall thicknesses according to an aspect of the present invention.

The first wall 59 of the mounting collar 53 can have a first alignment member 89 and the second wall 71 of the clamping collar 65 can have a second alignment member 91. The first alignment member 89 and the second alignment member 91 can be positioned so that, when the first plate 55 is mounted so that its top surface 61 faces and is mounted against an exterior or bottom 45 of the boat hull 25 and the second plate 67 faces and is mounted against an interior or top 95 of the boat hull with the first cylinder 63 received in the second cylinder 75, the first alignment member and the second alignment member align when the boat hull is at least a predetermined thickness Tmin (FIG. 4). Tmin is determined as the minimal hull thickness sufficient to support the weight of and force transmitted by the drive. In this way, it is possible to ensure that the drive unit 31 is not mounted to a hull wall 27 that is of insufficient thickness to support the drive unit.

For purposes of the present application, the first and second plates 55 and 67 will be considered to be "mounted against" the exterior and the interior of the hull 25 even though material such as adhesive and/or gaskets may be disposed between the plates and the hull. The thickness of any material between the plates 55 and 67 and the wall 27 of the hull 25 will ordinarily be taken into consideration when determining what the positions of the first and second alignment members 89 and 91 are to be on the first and second walls 59 and 71. The first plate 55 and the second plate 67 will ordinarily have through holes provided therein for fastening the plates together with the wall 27 of the boat hull 25 sandwiched between the plates. Ordinarily, the wall 27 of the boat hull will also have through holes 102 provided therein through which fasteners such as bolts 103, screws, rivets, or the like can extend for fastening the first and second plates 55 and 67 and the wall 27 together. As seen in FIG. 4, a bolt 103 can extend through a through hole 104 provided in the second plate 67 of the clamping collar 65 and external threads on the bolt mate with internal threads provided in a boss 106 extending upwardly from a metal plate 108 and through a hole 102 in the wall 27 of the hull 25 and a hole 110 in the first plate 55 of the mounting collar 53. The plate 108 can be disposed in a recess 112 in the first plate 55 of the mounting collar 53.

The first alignment member 89 and the second alignment member 91 can also be arranged to align when the boat hull 25 is no more than a predetermined thickness $T_{max}$ (FIG. 4), which is greater than Tmin, i.e., the mounting collar 53 and the clamping collar 65 can be attached to hulls having thicknesses within a predetermined range of thicknesses, such as may be desirable to accommodate hull wall 27 thickness variations and thickness variations in gaskets or adhesives between the hull wall and the plates. Alternatively, the first alignment member 89 and the second alignment member 91 can be configured to align only when the boat hull 25 (including gaskets and adhesive) is a predetermined thickness, such as by providing the first and second alignment members in the form of holes that only align in one position, as shown in FIG. 1. Ordinarily, the first and second alignment members are first and second holes 89 and 91 extending at least partially through the first and second walls 59 and 71, respectively. A pinning structure 109, such as a rod, a bolt, a screw, or the like, can be received in both of the holes 89 and 91 when the mounting collar 53 and the clamping collar 65 are properly aligned relative to each other. When it is desired to accommodate hull wall 27 thickness variations and thickness variations in gaskets and/or adhesives between the hull wall and the plates 55 and 67, one of the first and second holes 89 and 91 can be elongated in a direction of an axis A of the first and second cylinders 63 and 75. FIG. 4 shows, in exaggerated fashion, the hole 91 forming the first alignment member 91 on the second wall 71 of the clamping collar 65 as an elongated hole permitting the mounting arrangement 23 to accommodate different wall thicknesses for the hull wall 27 (thinner and thicker hulls 25 shown in phantom). It will be appreciated that the hole 89 in the first wall 59 could be elongated, in addition or in the alternative to making the hole 91 in the second wall 71 elongated. The first alignment member 89 can comprise a first hole 89 extending at least partially through the peripheral flange 77. In the embodiment shown in FIG. 4, the first hole 89 is an internally threaded hole for receiving an externally threaded bolt 109.

In addition to ensuring axial alignment of the cylinders 63 and 75 of the mounting collar 53 and the clamping collar 65, extending a pinning structure 109 into the walls 59 and 71 can ensure that there is no relative rotation about the axes of the cylinders, such as might occur if the cylinders are circular in shape. Ordinarily, to minimize the possibility of relative rotation the cylinders are non-circular and, typically, they are oval or elliptical, although other geometries are also possible.

Figure 3B:
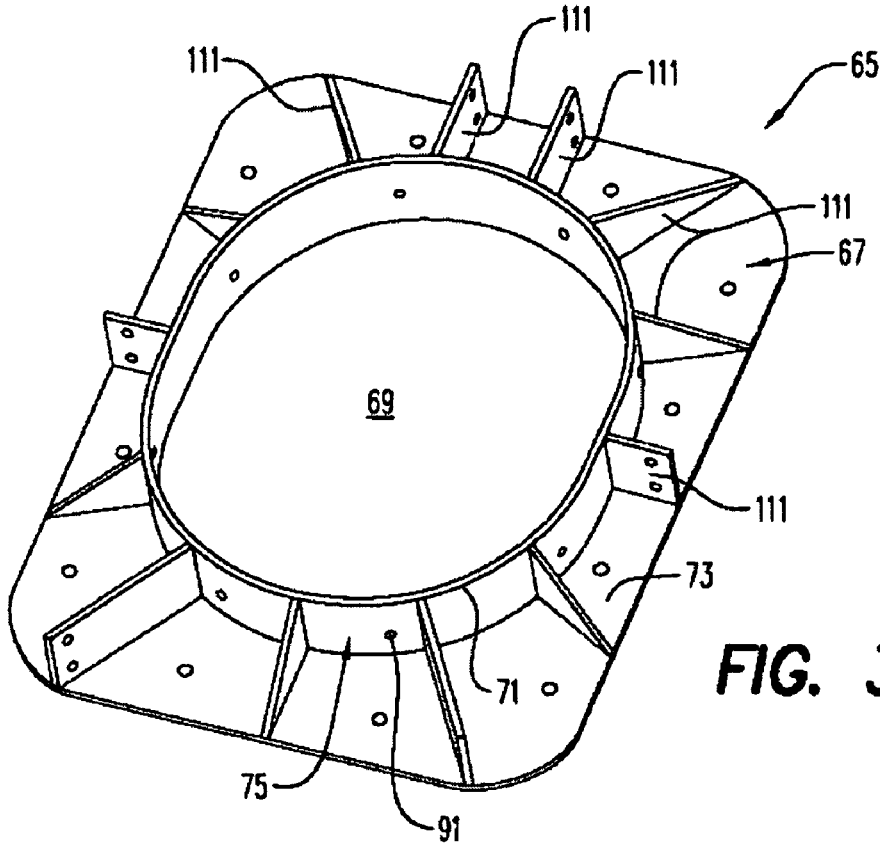
FIG. 3B is a perspective view of a clamping collar according to an aspect of the present invention.
Figure 3A:
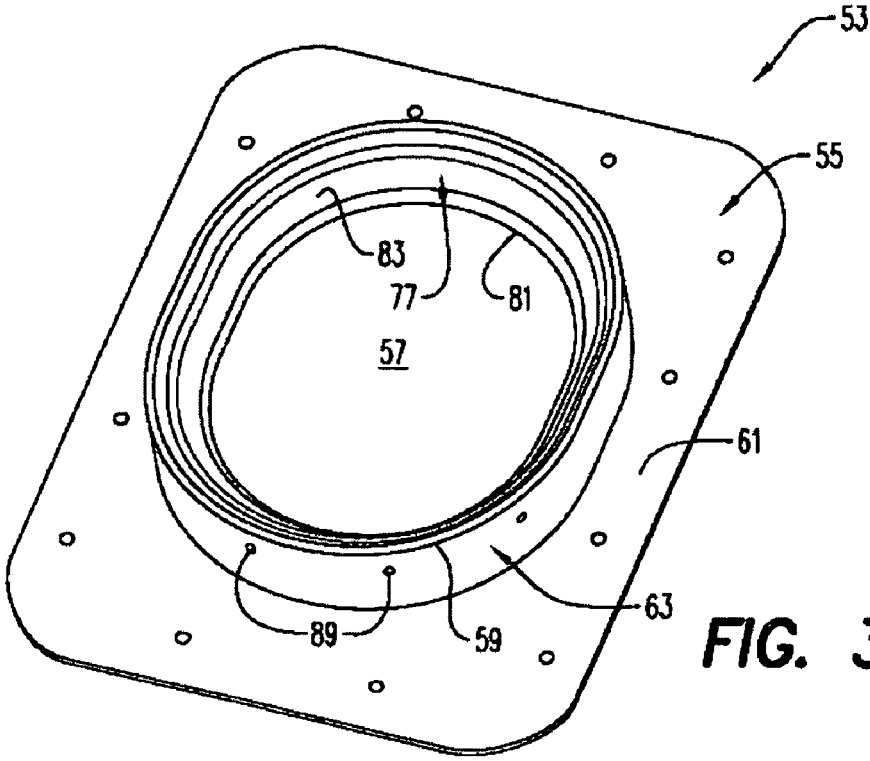
FIG. 3A is a perspective view of a mounting collar according to an aspect of the present invention.

As seen in, for example, FIGS. 3B and 5, the clamping collar 65 can comprise one or more strengthening ribs 111 between an exterior periphery of the second cylinder 75 and the top 73 of the second plate 67. The ribs 111 can strengthen the second cylinder so that forces from the drive unit 31 that are not absorbed by, e.g., the compressible rings 85 and 87 can be absorbed, at least in part, by the clamping collar 65. As seen in FIG. 5, at least one bracket 113 can be provided for attaching to at least one of the ribs 111 and an internal structure such as a rib 115 on the boat hull 25, further facilitating transmission of forces from the drive unit 31 to the hull 25 of the boat, as opposed to, for example, an engine (not shown) connected to the horizontal shaft 51. In this way, the engine can be mounted on relatively soft, vibration-damping pads. The rings 85 and 87 can also minimize vibration.

In a method of mounting a drive unit 31 to a hull 25 of a boat 21, the mounting collar 53 comprising the first plate 55 having the first opening 57 therein and the first wall 59 extending from the top surface 61 of the first plate around the first opening and defining the first cylinder 63 is provided. The first wall 59 comprises the peripheral flange 77 extending around the inside of the wall. The top 61 of the first plate 55 faces a bottom 45 of the hull 25. The first wall 59 extends upwardly through an opening 29 in the wall 27 of the hull 25.

The clamping collar 65 comprising the second plate 67 having the second opening 69 therein and the second wall 71 extending from the top surface 73 of the second plate around the second opening and defining the second cylinder 75 is provided. The external shape of at least the top end of the first cylinder 63 substantially matches the internal shape of at least the bottom end 75 of the second cylinder. The clamping collar 65 is positioned so that the bottom of the second plate 67 faces the top of the hull and the first cylinder 63 is at least partially received in the second cylinder 75.

The mounting plate 33 of the drive unit 31 is positioned so that the upwardly facing, substantially frustoconical mounting surface 35 of the mounting plate faces the downwardly facing, substantially frustoconical mounting surface 81 of the peripheral flange 77. The hold down plate 37 is positioned so that the downwardly facing, substantially frustoconical mounting surface 39 of the hold down plate faces the upwardly facing substantially frustoconical mounting surface 85 of the peripheral flange 77. The hold down plate 37 is then fastened to the mounting plate 33, ordinarily via fasteners 117 such as bolts, screws, rivets, or the like, with the peripheral flange 77 sandwiched between the surfaces 35 and 39. The fasteners 117 can also extend through the peripheral flange 77 to minimize the possibility of movement of the drive unit 31 relative to the mounting arrangement 23.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A mounting arrangement for mounting a boat drive to a boat hull, comprising:

a mounting collar comprising a first plate having a first opening therein and a first wall extending from a top surface of the first plate around the first opening and defining a first cylinder;

a clamping collar comprising a second plate having a second opening therein and a second wall extending from a top surface of the second plate around the second opening and defining a second cylinder, an external shape of at least a top end of the first cylinder substantially matching an internal shape of at least a bottom end of the second cylinder; and the first wall of the mounting collar having a first alignment member and the second wall of the clamping collar having a second alignment member, the first alignment member and the second alignment member being positioned so that, when the first plate is mounted against an exterior of the boat hull and the second plate is mounted against an interior of the boat hull with the first cylinder received in the second cylinder, the first alignment member and the second alignment member align when the boat hull is at least a first predetermined thickness.

2. The mounting arrangement as set forth in claim 1, wherein the first alignment member and the second alignment member align when the boat hull is no more than a second predetermined thickness, the second predetermined thickness being greater than the first predetermined thickness.

3. The mounting arrangement as set forth in claim 1, wherein the first alignment member and the second alignment member align only when the boat hull is the first predetermined thickness.

4. The mounting arrangement as set forth in claim 1, wherein the first and second alignment members are first and second holes extending at least partially through the first and second walls, respectively.

5. The mounting arrangement as set forth in claim 4, wherein one of the first and second holes is elongated in a direction of an axis of the first and second cylinders.

6. The mounting arrangement as set forth in claim 1, wherein the first wall comprises a peripheral flange extending around an inside of the wall.

7. The mounting arrangement as set forth in claim 6, wherein at least one of a top and a bottom edge of the peripheral flange is generally frustoconical.

8. The mounting arrangement as set forth in claim 7, wherein both the top and the bottom edge of the peripheral flange are generally frustoconical.

9. The mounting arrangement as set forth in claim 6, wherein the first alignment member comprises a hole extending at least partially through the peripheral flange.

10. The mounting arrangement as set forth in claim 1, wherein the clamping collar comprises at least one strengthening rib between an exterior periphery of the second cylinder and the top of the second plate.

11. The mounting arrangement as set forth in claim 10, comprising at least one bracket attachable to the at least one rib and an internal structure on the boat hull.

12. A boat comprising a hull and a drive unit and the mounting arrangement as set forth in claim 1.

13. A boat comprising:

a hull, the hull having a wall and an opening extending through the wall;

a drive unit comprising a mounting plate having an upwardly facing, substantially frustoconical mounting surface;

a hold down plate having a downwardly facing, substantially frustoconical mounting surface; and a mounting arrangement for mounting the boat drive to the boat hull, comprising a mounting collar comprising a first plate having a first opening therein and a first wall extending from a top surface of the first plate around the first opening and defining a first cylinder, the first wall comprises a peripheral flange extending around an inside of the wall, a clamping collar comprising a second plate having a second opening therein and a second wall extending from a top surface of the second plate around the second opening and defining a second cylinder, an external shape of at least a top end of the first cylinder substantially matching an internal shape of at least a bottom end of the second cylinder;

wherein the peripheral flange comprises a downwardly facing, substantially frustoconical mounting surface arranged to face the upwardly facing, substantially frustoconical mounting surface of the mounting plate of the drive unit, and an upwardly facing, substantially frustoconical mounting surface arranged to face the downwardly facing, substantially frustoconical mounting surface of the hold down plate.

14. The boat as set forth in claim 13, comprising a plurality of fasteners arranged to extend through at least one of the hold down plate and the mounting plate to secure the hold down plate and the mounting plate on opposite sides of the peripheral flange.

15. The boat as set forth in claim 13, wherein the first wall of the mounting collar has a first alignment member and the second wall of the clamping collar has a second alignment member, the first alignment member and the second alignment member being positioned so that, when the first plate is mounted against an exterior of the boat hull and the second plate is mounted against an interior of the boat hull with the first cylinder received in the second cylinder, the first alignment member and the second alignment member align when the boat hull is at least a predetermined thickness.

16. The boat as set forth in claim 15, wherein the first alignment member comprises a first hole extending at least partially through the peripheral flange.

17. The boat as set forth in claim 16, wherein the second alignment member comprises a second hole extending through the second wall, a pinning member extending through the second hole and into the first hole.

18. The boat as set forth in claim 13, wherein the clamping collar comprises at least one strengthening rib between an exterior periphery of the second cylinder and the top of the second plate.

19. The boat as set forth in claim 18, comprising at least one bracket attachable to the at least one rib and an internal structure on the boat hull.

20. A method of mounting a drive unit to a hull of a boat, comprising:

positioning a mounting collar comprising a first plate having a first opening therein and a first wall extending from a top surface of the first plate around the first opening and defining a first cylinder, the first wall comprising a peripheral flange extending around an inside of the wall, so that the top of the first plate faces a bottom of the hull and so that the first wall extends upwardly through an opening in a wall of the hull;

positioning a clamping collar comprising a second plate having a second opening therein and a second wall extending from a top surface of the second plate around the second opening and defining a second cylinder, an external shape of at least a top end of the first cylinder substantially matching an internal shape of at least a bottom end of the second cylinder, so that a bottom of the second plate faces a top of the hull and the first cylinder is at least partially received in the second cylinder;

positioning a mounting plate of the drive unit so that an upwardly facing, substantially frustoconical mounting surface of the mounting plate faces a downwardly facing, substantially frustoconical mounting surface of the peripheral flange;

positioning a hold down plate so that a downwardly facing, substantially frustoconical mounting surface of the hold down plate faces an upwardly facing substantially frustoconical mounting surface of the peripheral flange; and fastening the hold down plate to the mounting plate via fasteners.

* * * * *